US005653283A

United States Patent [19]

Yoshii et al.

[11] Patent Number: 5,653,283

[45] Date of Patent: Aug. 5, 1997

[54] LAMINATED TYPE HEAT EXCHANGER

[75] Inventors: Keiichi Yoshii, Anjo; Etsuo Hasegawa, Nagoya; Toshiya Nagasawa, Obu; Masatoshi Sudo, Kariya, all of Japan

[73] Assignee: Nippondenso Co., Ltd., Kariya, Japan

[21] Appl. No.: 634,727

[22] Filed: Apr. 19, 1996

[30] Foreign Application Priority Data

Apr. 21, 1995 [JP] Japan ..... 7-097101

[51] Int. Cl.[6] ..... F28D 1/03

[52] U.S. Cl. ..... 165/152; 165/153; 165/DIG. 464; 165/DIG. 465; 165/134.1

[58] Field of Search ..... 165/152, 153, 165/134.1, DIG. 464–DIG. 467

[56] References Cited

U.S. PATENT DOCUMENTS

| | | | |
|---|---|---|---|
| 4,815,532 | 3/1989 | Sasaki et al. | 165/152 |
| 4,926,932 | 5/1990 | Ohara et al. . | |
| 5,236,045 | 8/1993 | Janezich et al. | 165/183 |

FOREIGN PATENT DOCUMENTS

| | | | |
|---|---|---|---|
| 29175 | of 1909 | United Kingdom | 165/153 |

*Primary Examiner*—Allen J. Flanigan
*Attorney, Agent, or Firm*—Harness, Dickey & Pierce

[57] ABSTRACT

According to the present invention, the tube element includes a connecting portion for connecting the pair of core plates at an upstream air side, an extending portion extending from each of the connecting portions of the core plate at the upstream air side and having a fin connecting portion connected to the corrugated fin, and a further upstream end portion of the extending portion located at an upstream side of the fin connecting portion which is located away from the corrugated fin to form a predetermined gap with the corrugated fin so as to communicate with the air passage. The extending portion including the fin connecting portion closes the whole space between the tube elements and the adjacent corrugated fins at the more upstream air side of the refrigerant passage, so that the air entering between the tube elements and the adjacent corrugated fins can be substantially shut off.

12 Claims, 6 Drawing Sheets

LAMINATED TYPE HEAT EXCHANGER

CROSS REFERENCE TO RELATED APPLICATION

This application is based upon and claims priority of Japanese Patent Application No. 7-97101 filed on Apr. 21, 1995, the contents of which are incorporated herein.

BACKGROUND OF THE INVENTION

1. Field of the Invention

The present invention relates to a laminated type heat exchanger, which is suitably employed as a refrigerant evaporator of an automotive air conditioner.

2. Description of Related Art

In a well-known conventional laminated type heat exchanger for an automotive air conditioner, a corrugated fin and a tube element including a pair of symmetrical core plates are laminated to each other. For example, in JP-A-64-41794, and as shown in FIG. 7, the upstream end (with respect to the air flow) 4*g* of core plates 4 which together form a tube element 2 is spaced from a corrugated fin 3 as shown in FIG. 7, so that condensed water can be drained through corrugated fin 3 and the vent portion can be prevented from being clogged due to the generation of the condensed water.

However, in the structure of tube element 2 disclosed in the above-described prior art, dust and dirt contained in the air passing through a heat exchanging portion enter through a gap 6 between the upstream end 4*g* of core plate 4 and the upstream end portion of corrugated fin 3 and adhere to tube wall 5*a* of the refrigerant passage. In this case, when the dust contains some ingredients which promote corrosion of tube wall 5*a* such as copper particles, tube wall 5*a* of tube element 2 will corrode causing a refrigerant leak.

SUMMARY OF THE INVENTION

In light of the above-described problem, the present invention has an object to provide a laminated type heat exchanger which can prevent dust and dirt contained in the flowing air from directly contacting the tube wall of the tube element and thus prevent corrosion of the tube element which eventually will lead to the refrigerant leaking.

According to the present invention, a laminated type heat exchanger includes a plurality of tube elements forming a refrigerant passage in which refrigerant flows by connecting a pair of basin-shaped core plates at the outer peripheries thereof in such a manner that air passages are formed between adjacent tube elements. A corrugated fin is disposed in the air passage and thermally connected at both sides of the tube elements. Heat exchange occurs between air flowing in the air passage and the refrigerant flowing in the refrigerant passage to exchange heat to cool the air. The tube element includes a connecting portion for connecting the pair of core plates at an upstream air side, an extending portion extending from each of the connecting portions of the core plate at the upstream air side and a fin connecting portion connected to the corrugated fin. The most upstream end portion of the extending portion located at an upstream side of the fin connecting portion is spaced away from the corrugated fin to form a predetermined gap with the corrugated fin so as to communicate with the air passage.

According to the above configuration, the extending portion including the fin connecting portion closes the entire space between the tube element and the adjacent corrugated fins at the upstream air side of the refrigerant passage, so that the air which otherwise would enter from between the tube element and the adjacent corrugated fins can be substantially shut off. As a result, ingredients which promote corrosion such as dust and dirt contained in the air passing between the adjacent corrugated fins can be prevented from adhering to the connecting portion of the core plates and the tube wall of the refrigerant passage, thus improving corrosion resistance of the tube element and preventing the refrigerant from leaking. By forming a gap having a predetermined distance between the most upstream end portion of the extending portion and the corrugated fin, a part of the air flowing into the space between the adjacent corrugated fins can be sent to the air passage through the corrugated fins. The air flow resistance caused by the air flowing into the space between the adjacent corrugated fins can be reduced.

When the core plate is formed in the same shape at the both air upstream and downstream sides in the longitudinal direction, a symmetrical core plate can be made. Thus, only one kind of core plate is applied to form a tube element which reduces the number of parts.

Other objects and features of the invention will appear in the course of the description thereof, which follows.

BRIEF DESCRIPTION OF THE DRAWING

Additional objects and advantages of the present invention will be more readily apparent from the following detailed description of preferred embodiments thereof when taken together with the accompanying drawings in which.

DETAILED DESCRIPTION OF THE PRESENTLY PREFERRED EXEMPLARY EMBODIMENTS

Figure 1:
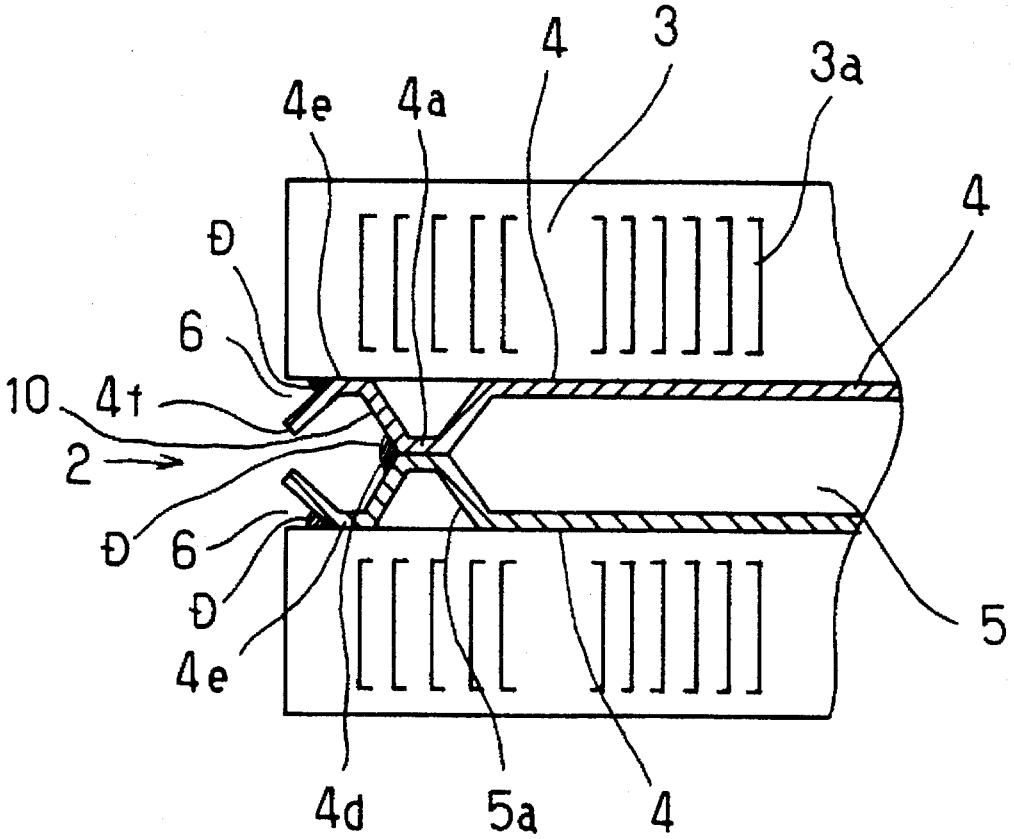
FIG. 1 is a cross-sectional view illustrating a tube element and a fin at the upstream air side of the air flow.
Figure 2:
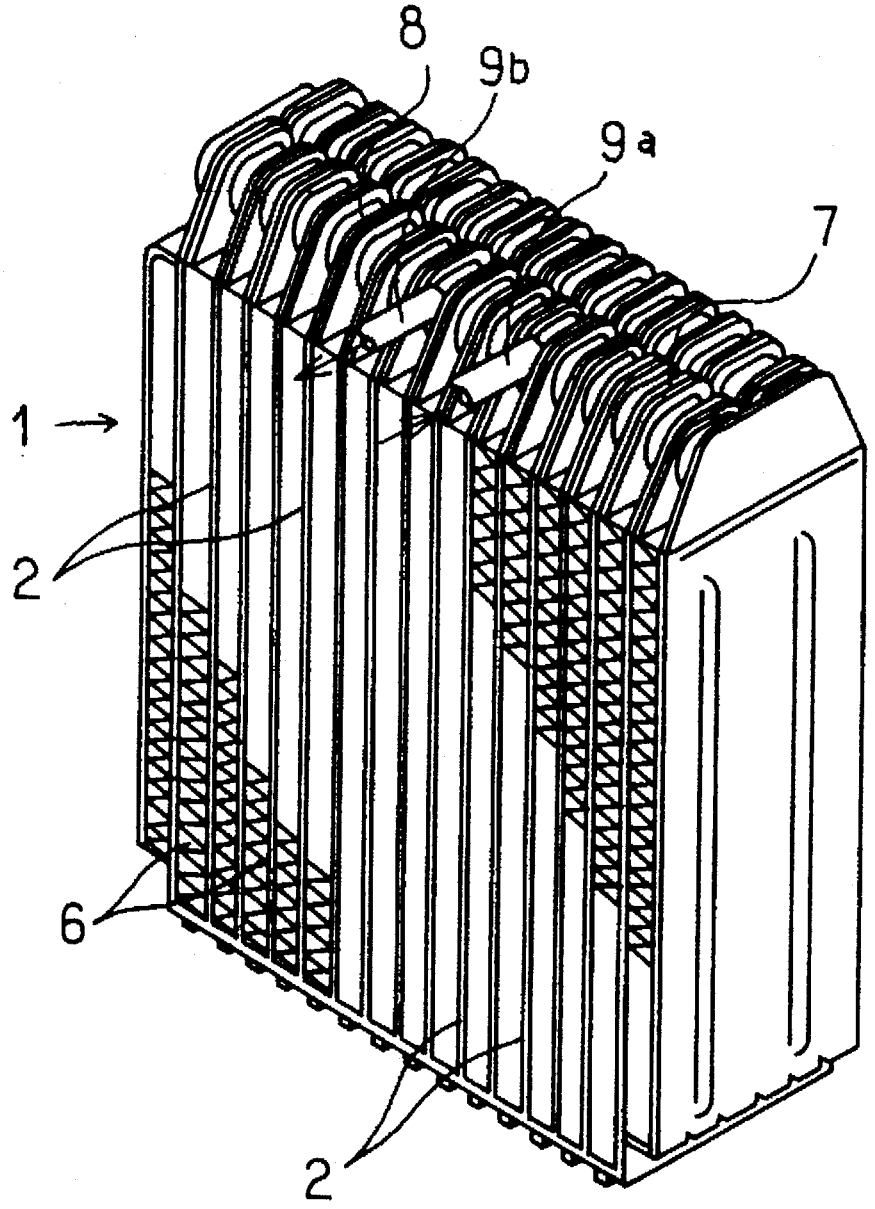
FIG. 2 is a front perspective view of a refrigerant evaporator.
Figure 3:
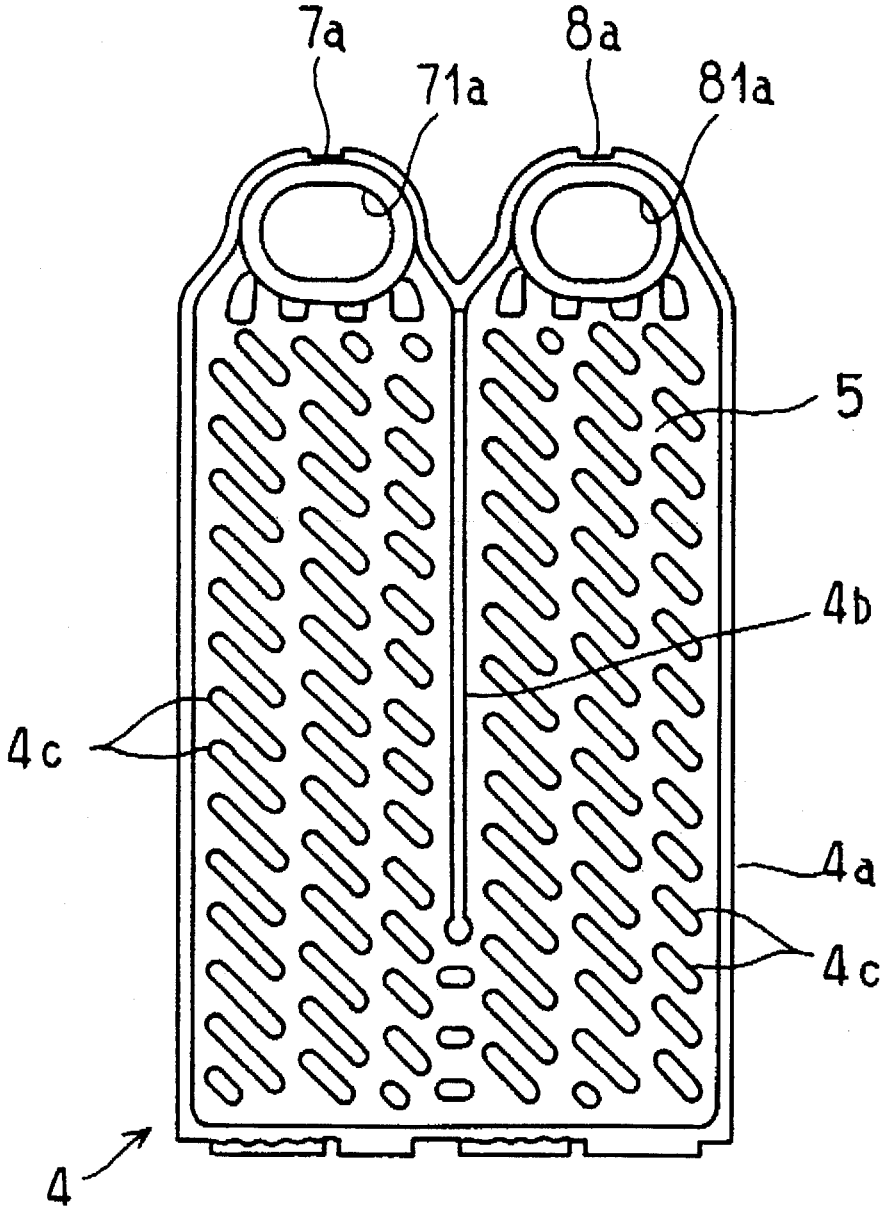
FIG. 3 is a front view of a core plate.

Preferred embodiments where the present invention is applied to a refrigerant evaporator of an automotive air conditioner are hereinafter described with reference to the accompanying drawings, According to embodiment shown in FIGS. 1–3, FIG. 2 is a view taken from the upstream direction of the air passing through a refrigerant evaporator 1 of an automotive air conditioner to which the present invention is applied.

Refrigerant evaporator 1 includes a plurality of tube elements 2 each forming a refrigerant passage 5 between core plates 4, i.e., a pair of symmetrical basin-shaped core plates connected at outer peripheries thereof and corrugated fins 3 (hereinafter called fins 3) for improving heat exchange performance.

Core plate 4 is formed by pressing an aluminum-clad plate, clad with 10–15% of aluminum-brazed material on both surfaces.

As shown in FIG. 3, core plate 4 is substantially rectangular and has at a top portion thereof an inlet tank chamber 7a for forming an inlet tank 7 and an outlet tank chamber 8a for forming an outlet tank 8. The portion between inlet tank chamber 7a and outlet tank chamber 8a of core plate 4 serves as refrigerant passage 5 communicating with both inlet and outlet tank chambers 7a and 8a. Tube element 2 is formed by a pair of core plates 4 including inlet tank chamber 7a, outlet tank chamber 8a and refrigerant passage 5 being connected together, In a pair of core plates 4, the concave surface of one core plate faces the concave surface of the other core plate. The outer peripheries of core plates 4 serve as a connecting portion 4a for connecting core plates 4 to each other. The shapes of the upstream end and the downstream end of core plates 4 with respect to the air flow are described later.

Each of inlet and outlet tank chambers 7a and 8a is formed in a basin shape so as to protrude in a laminated direction of tube element 2, and these chambers, 7a and 8a, have communicating holes 71a and 81a, respectively.

A center rib 4b extending vertically is provided at the center of the width of core plate 4 to form the substantially U-shaped refrigerant passage 5. The portion serving as refrigerant passage 5 has many protruding ribs 4c on the entire surface thereof. When a pair of core plates 4 are connected to form tube element 2, ribs 4c face each other crosswise, and thereby the heat exchanging area of the refrigerant is increased and the flow of the refrigerant is made turbulent to improve the heat conductivity.

As stated above, tube element 1 is formed by connecting two core plates 4. Core plates 4, of which left and right parts are symmetrical, are connected to each other by brazing connecting portion 4a. Refrigerant passage 5 is formed in tube element 2 perpendicularly with respect to the vertical direction of FIG. 1.

Fin 3 is formed by folding a thin plate into a corrugated shape such that the air can flow between each folded plate surfaces. The plate surface of fin 3 is provided with louvers 3a to promote the heat exchanging efficiency.

As shown in FIG. 3, the plurality of tube elements 2 are laminated substantially perpendicularly with respect to the air flow, and the air passes between tube walls 5a of refrigerant passages 5 on the adjacent tube elements 2, serving as an air passage. Fin 3 is disposed in the air passage and connected to adjacent tube walls 5a of refrigerant passages 5. When each tube element 2 and its respective fin 3 are laminated, an end plate is connected to the end portions of tube element 2 and fin 3, so that the right and left end walls and the top and the bottom end walls of refrigerant evaporator 1 are closed from the outside. After tube elements 2 and fins 3 are laminated and temporarily assembled, the assembly is integrally brazed by being heated in a furnace (not shown).

When tube elements 2 are laminated, the adjacent inlet tank chambers 7a communicate with each other through communicating holes 71a of inlet tank chambers 7a in order to form inlet tank 7. Also, when tube elements 2 are laminated, the adjacent outlet tank chambers 8a communicate with each other through their communicating holes 81a of outlet tank chambers 8a in order to form outlet tank 8. However, when laminated, communicating hole 71a of inlet tank chamber 7a and communicating hole 81a of outlet tank chamber 8a at both ends of tube element 2 are closed with the end plates.

An inlet pipe 9a is connected to inlet tank 7 to introduce the refrigerant into each tube element 2 from the refrigerant circuit (not shown). An outlet pipe 9b is connected is connected to outlet tank 8 to introduce the refrigerant flowing out from each tube element 2 into the refrigerant circuit.

FIG. 1 is a cross-sectional view of tube element 2 and fin 3 along the parallel plane with respect to the air flow direction at the upstream side thereof.

As shown in FIG. 1, each core plate 4 forming tube element 2 is bent in the direction away from each other at upstream from connecting portion 4a. Each cure plate 4 extends to the upstream air side from a bent portion 4d and is connected to fin 3 at a fin connecting portion 4e which is at a more upstream side of the air flow than connecting portion 4a. At fin connecting portion 4e for connecting core plate 4 and fin 3, each core plate 4 is bent again to extend further toward the upstream air side. As shown in FIG. 1, the end portions 4f of each respective cure plate 4 are bent towards each other.

Since core plate 4 is formed as described above, fin connecting portion 4e is disposed at a more upstream side of the air flow than tube wall 5a which is at the upstream side of refrigerant passage 5, and end portion 4f is disposed at a upstream side of the air flow than fin connecting portion 4e.

A gap 6 having a predetermined distance is formed between end portion 4f of core plate 4 and the upwind end portion of fin 3. Core plate 4 is bent at fin connecting portion 4e so that the distance between end portion 4f of core plate 4 and fin 3 is gradually reduced in the flowing direction of the air. Gap 6 communicates with the air passage between adjacent tube elements 2 via fin 3.

Connecting portion 4a and fin connecting portion 4e in core plate 4 both include flat surfaces each having an appropriate width so that these flat portions are brazed firmly.

Although it is not illustrated, the air upstream and downstream sides of respective core plate 4 have the same shape in the longitudinal direction. The downstream end in the air flow of core plate 4 is symmetrically formed with respect to center rib 4b.

An operation of the present embodiment is hereinafter explained.

After the refrigerant flows into each tube element 2 through inlet pipe 9a from the refrigerant circuit and passes refrigerant passage 5, the refrigerant exchanges heat with the air passing in the air passage and the refrigerant is sent out to the refrigerant circuit through outlet pipe 9b. On the other hand, the air passes through the air passages shown in FIG. 2 and flows from the left to right in FIG. 1.

Each core plate 4 for forming tube element 2 is bent away from each other at a more upstream position than connecting portion 4a to form portion 4d. Each core plate 4 extends to the upstream air side from bent portion 4d to form portion 4e and is connected to fin 3. Since fin connecting portion 4e for connecting each core plate 4 and fin 3 is located at a more upstream side of the air flow than connecting portion 4a, some of the air passing through refrigerant evaporator 1 cannot go into the space between adjacent fins 3 and core plate 4, because the air flow is actually obstructed by an extending portion 10 extending from bent portion 4d of core plate 4. Thus, the air cannot flow into the sides of connecting portion 4a and tube wall 5a of refrigerant passage 5. If the air passing through refrigerant evaporator 1 contains corrosion-promoting ingredients such as copper and these corrosion-promoting ingredients adhere to extending portion 10 extending from bent portion 4d, such ingredients will be prevented from adhering to connecting portion 4a and tube wall 5a of refrigerant passage 5. As a result, connecting portion 4a and tube wall 5a of refrigerant passage 5, which are the most important portions to prevent the leakage of the refrigerant, can be prevented from being corroded, improving the corrosion resistance. The prevention of corrosion eliminates holes caused by the corrosion of connecting portion 4*a* and tube wall 5*a* of refrigerant passage 5 and the refrigerant is prevented from leaking.

Since gap 6 has a predetermined distance communicating with the air passage through fin 3 some of the air having flowed between core plate 4 and adjacent fins 3 flows into this gap 6. The air having flowed into gap 6 can enter the communicating air passage through fin 3, so that air flow resistance can be reduced.

Moreover, because each core plate 4 has a symmetrical shape with respect to center rib 4*b*, the number of parts for presswork can be reduced as well as the number of dies for the presswork. Each core plate 4 has a symmetrical shape and a gap which has a predetermined distance communicating with the air passage via fin 3 so that the air passing between core plate 4 and the adjacent fins 3 can have a larger flowing area at the downstream end of the air, thus the air flow resistance can be further reduced.

Another embodiment is hereinafter described with reference to FIG. 4.

In this embodiment, core plate 4 extends from bent portion 4*d* toward tube wall 5*a* at an upstream air side of refrigerant passage 5 and core plate 4 is connected to fin 3 at a more upstream side of the air flow than tube wall 5*a* of refrigerant passage 5.

Figure 4:
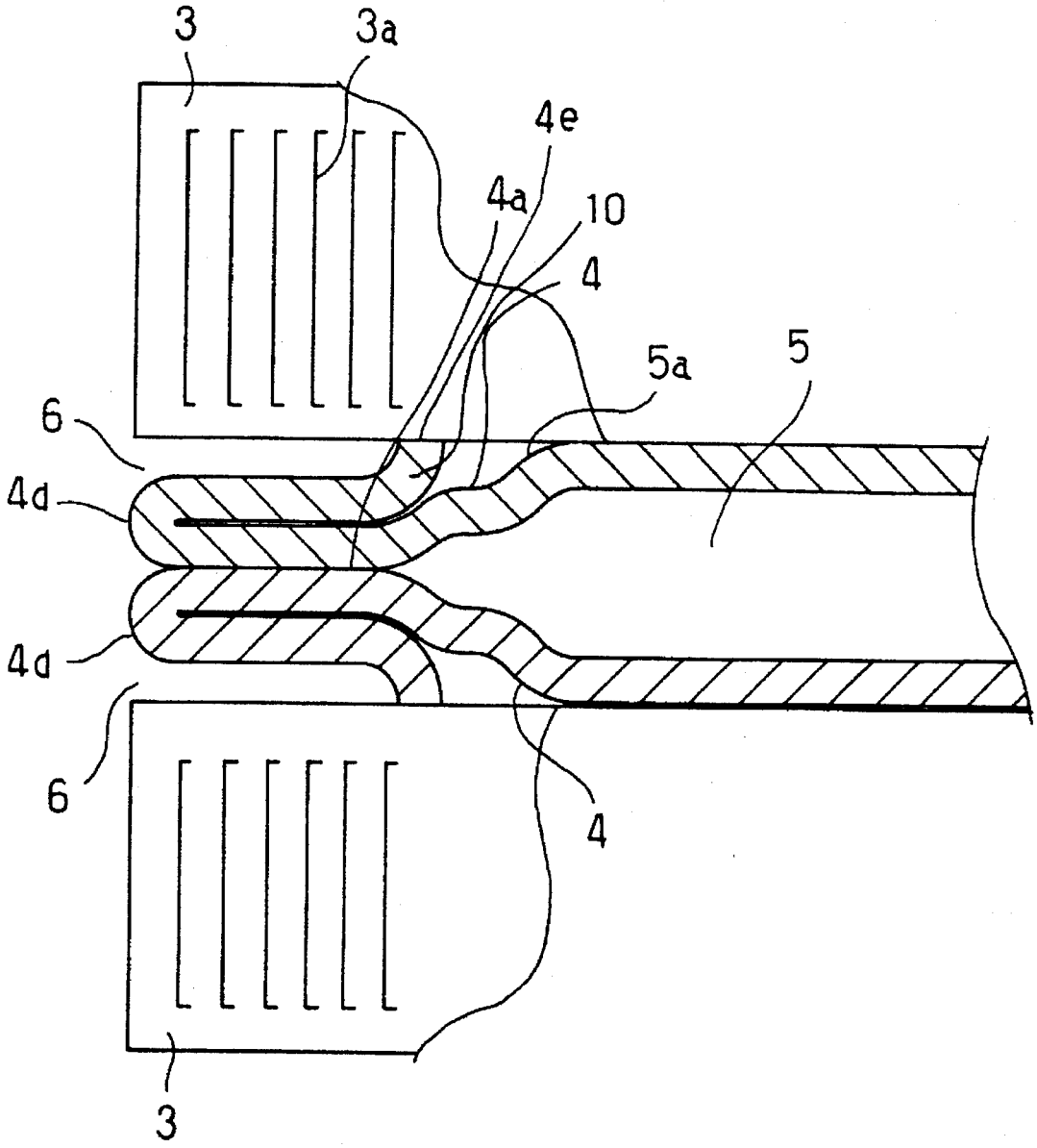
FIG. 4 is a cross-sectional view illustrating a tube element and a fin at the upstream air side in another embodiment.

FIG. 4 is a cross-sectional view of tube element 2 and fins 3 along the parallel plane with respect to the air flow direction at the upstream side thereof.

Refrigerant evaporator 1, similar to the previous embodiment, includes tube element 2 where a pair of core plates 4 are connected face to face and both tube element 2 and fins 3 are laminated and connected with each other by brazing.

As shown in FIG. 4, each core plate 4 for forming tube element 2 is bent so that bent portion 4*d* is formed in a substantially U-shape and extends from bent portion 4*d* to tube wall 5*a* at the upstream air side of refrigerant passage 5. End portion 4*e* of each core plate 4 is connected to fin 3 between bent portion 4*d* and tube wall 5*a* at the upstream air side of refrigerant passage 5, thereby tube wall 5*a* is actually shut out from the air flow. Bent portion 4*d* is positioned at the most upstream side of the air flow of core plate 4. Gap 6 having a predetermined distance is formed between portion 10, extending from bent portion 4*d* of core plate 4 to fin connecting portion 4*e*, and fin 3 facing portion 10. This gap 6 faces the air passage through fin 3.

Since the other structure is the same as in the previous embodiment, the explanation is omitted.

An operation of this embodiment is hereinafter described.

This embodiment also has the same effect as the previous embodiment. In addition, by bending bent portion 4*d* of core plate 4 in a substantially U-shape and by extending core plate 4 from bent portion 4*d* to tube wall 5*a* at the upstream air side of refrigerant passages to connect it to fin 3, portion 10 extending from bent portion 4*d* to fin connecting portion 4*e* can be overlapped on connecting portion 4*a* of core plate 4 so that the thickness of connecting portion 4*a* can be approximately doubled. Thus, without changing the thickness of core plate 4, corrosion resistance of core plate 4 can be further improved in comparison with the previous embodiment.

Another embodiment is hereinafter described with reference to FIG. 5.

Figure 5:
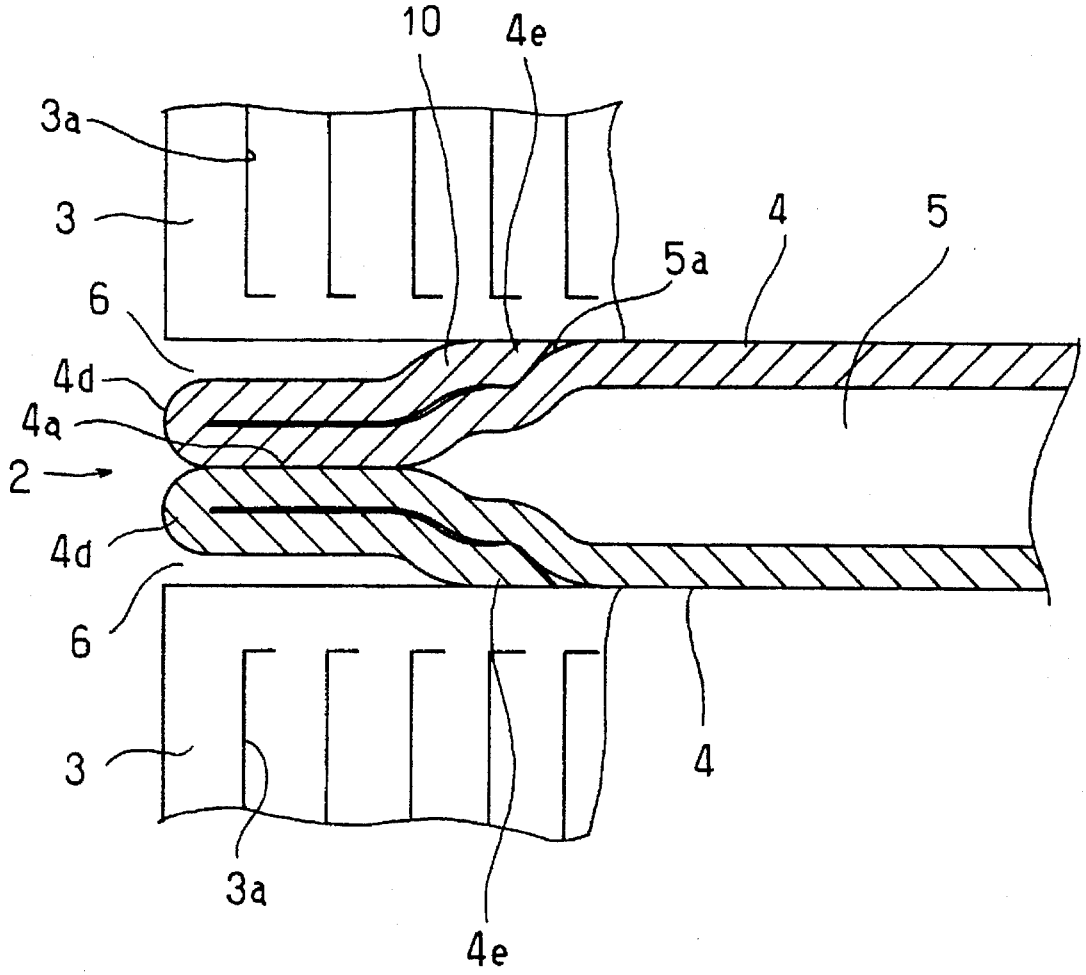
FIG. 5 is a cross-sectional view illustrating a tube element and a fin at the upstream air side in another embodiment.

In this embodiment as shown in FIG. 5, a portion 10 extends from portion 4*d* toward connected portion 4*a* where tube wall 5*a* of refrigerant passage 5 of core plate 4 and fin 3 are connected to each other. A portion extending from bent portion 4*d* to fin connecting portion 4*e* of core plate 4 and portion 10 make contact with each other in a wide range. Such a structure of the end portion of tube element 2 enables it to cover tube wall 5*a* of refrigerant passage 5 completely, thus further improving corrosion resistance of core plate 4.

Another embodiment is hereinafter described with reference to FIG. 6.

Figure 6:
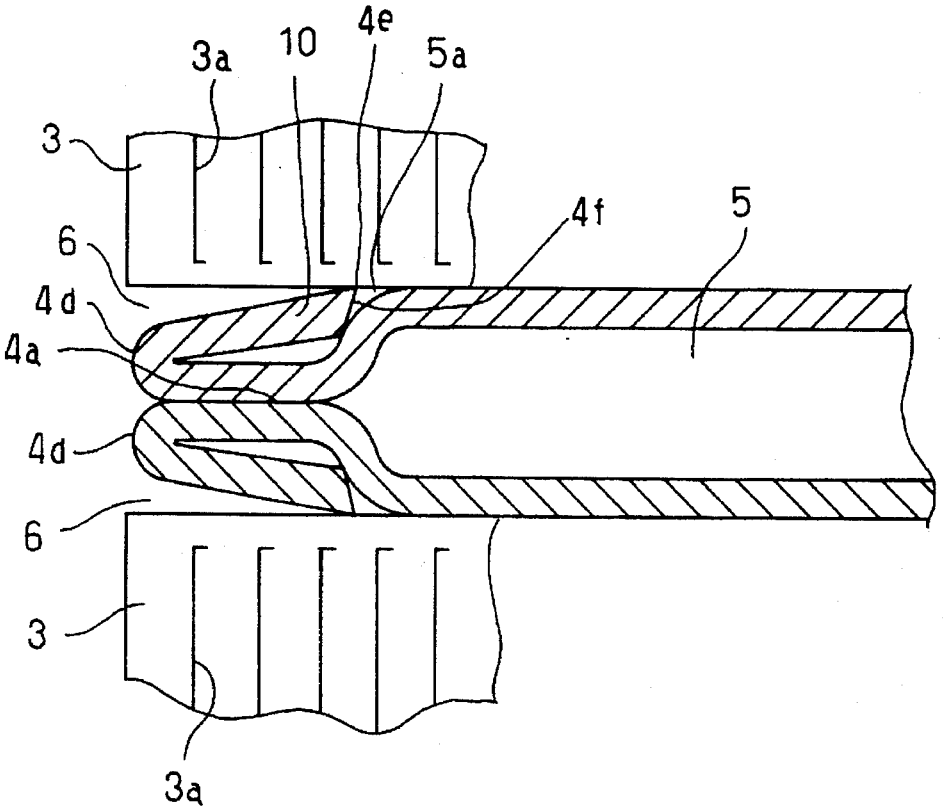
FIG. 6 is a cross-sectional view illustrating a tube element and a fin at the upstream air side in another embodiment.
Figure 7:
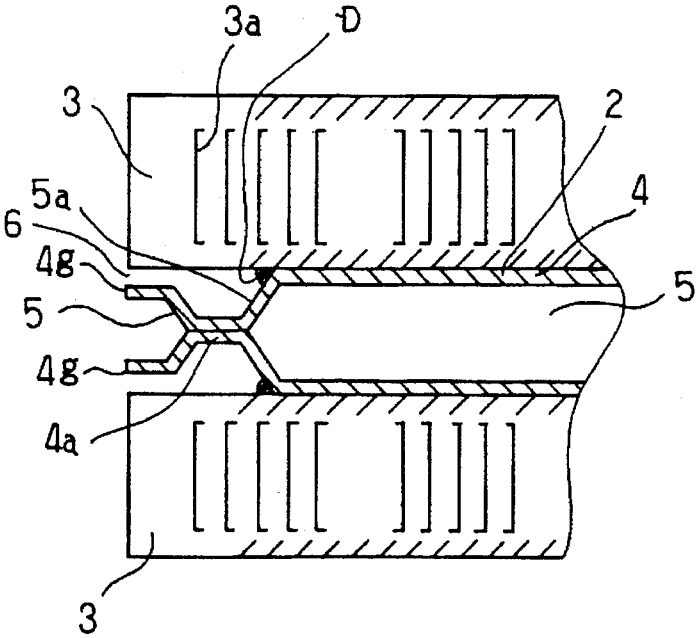
FIG. 7 PRIOR ART
FIG. 7 is a cross-sectional view illustrating a tube element and a fin in a prior art heat exchanger.

In this embodiment as shown in FIG. 6, bent portion 4*d* of core plate 4 is bent toward tube wall 5*a* of refrigerant passage 5, and end portion 4*f* of core plate 4 slightly contacts corrugated fin 3. In this case, portion 10 extending from bent portion 4*d* of core plate 4 to fin connecting portion 4*e* and connecting portion 4*a* may be slightly separated.

According to the above-described embodiment, each core plate 4 for forming a tube element is symmetrical with respect to the center rib, however, bent portion 4*d* and fin connecting portion 4*e* can be disposed only at the upstream side of the core plate with respect to the air flow. In other words, when at least the upstream side of the air flow in each core plate 4 has the above-mentioned structure, the air flow can be shut off by the portion from bent portion 4*d* of each core plate 4 to the fin connecting portion 4*e*, which are disposed at the more upstream side of the air flow than tube wall 5*a* of refrigerant passage 5. Corrosion-promoting ingredients contained in the air passing through a laminated heat exchanger can be effectively prevented from adhering to tube wall 5*a* of refrigerant passage 5, and corrosion resistance of core plate 4 can be improved. Moreover, the wind resistance can be decreased in the same manner as the previously-described embodiments.

Although the present invention has been fully described in connection with the preferred embodiments thereof with reference to the accompanying drawings, it is to be noted that various changes and modifications will become apparent to those skilled in the art. Such changes and modifications are to be understood as being included within the scope of the present invention as defined by the appended claims.

What is claimed is:

1. A laminated type heat exchanger comprising;

a plurality of tube elements forming a refrigerant passage in which refrigerant flows by connecting a pair of basin-shaped core plates at outer peripheries thereof in such a manner that air passages are formed between adjacent tube elements, heat exchange being performed between air flowing in said air passages and said refrigerant flowing in said refrigerant passage; and a corrugated fin disposed in each of said air passages and thermally connected to said adjacent tube elements;

wherein each of said tube elements includes:

a connecting portion for connecting said pair of core plates at an upstream air side;

an extending portion extending from each of said connecting portions at the upstream air side and having a fin connecting portion connected to a respective corrugated fin, and said extending portion having an end portion located at the upstream air side, said end portion being disposed away from said respective corrugated fin to form a predetermined gap with said respective corrugated fin, said predetermined gap communicating with a respective air passage.

2. A laminated type heat exchanger according to claim 1, wherein:

said extending portion of each core plate extends from said connecting portion toward the upstream air side in such a manner that said fin connecting portion connects with said respective corrugated fin at an upstream air side of said connecting portion, said end portion extending away from said respective corrugated fin towards the upstream air side, and said end portion having a tip end portion forming said predetermined gap with said respective corrugated fin.

3. A laminated type heat exchanger according to claim 1, wherein said extending portion extends from said connecting portion away from the upstream air side in such a manner that said fin connecting portion connects with said respective corrugated fin at a downstream air side of said connecting portion.

4. A laminated type heat exchanger according to claim 3, wherein said extending portion extends along a tube wall of said tube element.

5. A laminated type heat exchanger according to claim 3, wherein said connecting portion and said extending portion are integrally formed substantially in a U-shape.

6. A laminated type heat exchanger according to claim 1, wherein said tube element further includes:

a downstream connecting portion for connecting said pair of core plates at a downstream air side;

a downstream extending portion extending from each of said downstream connecting portions at the downstream air side and having a downstream fin connecting portion connected to said respective corrugated fin; and said downstream side extending portion having an end portion located at the downstream air side, said end portion being disposed away from said respective corrugated fin to form a predetermined gap with said respective corrugated fin, said predetermined gap communicating with said respective air passage.

7. A laminated type heat exchanger according to claim 1, wherein said tube element further includes:

a downstream connecting portion for connecting said pair of core plates at a downstream air side;

downstream extending portion extending from each of said downstream connecting portions at the downstream air side and having a downstream fin connecting portion connected to said respective corrugated fin; and said downstream connecting portion and said downstream extending portion have a symmetrical shape with said connecting portion and said extending portion of the upstream air side, respectively.

8. A laminated type heat exchanger according to claim 1, wherein said pair of core plates are connected at said connecting portion by brazing.

9. A laminated type heat exchanger comprising;

a plurality of tube elements forming a refrigerant passage in which refrigerant flows by connecting a pair of basin-shaped core plates at outer peripheries thereof in such a manner that air passages are formed between adjacent tube elements, heat exchange being performed between air flowing in said air passages and said refrigerant flowing in said refrigerant passage; and a corrugated fin disposed between said adjacent tube elements and having side connecting portions each thermally connected to an adjacent side surface of said adjacent tube elements;

wherein each of said tube element includes:

a protecting portion provided at an air upstream end portion thereof and having a fin connecting portion connected to said corrugated fin at an upstream side of said side connecting portion of said corrugated fin for preventing air from flowing to said side connecting portion; and an air introducing portion provided at an upstream side of said side connecting portion of said corrugated fin for introducing air having flowed between said adjacent corrugated fins toward a respective air passage.

10. A laminated type heat exchanger according to claim 9, wherein said protecting portion and said air introducing portion are formed by bending said outer peripheries of said core plates.

11. A laminated type heat exchanger comprising;

a plurality of tube elements forming a refrigerant passage in which refrigerant flows by connecting a pair of basin-shaped core plates at outer peripheries thereof in such a manner that air passages are formed between adjacent tube elements, heat exchange being performed between air flowing in said air passage and said refrigerant flowing in said refrigerant passage; and a corrugated fin disposed between said adjacent tube elements and having side connecting portions each thermally connected to an adjacent side surface of said adjacent tube elements;

wherein each of said tube element includes:

a guide portion provided on said outer peripheries of said core plates at an upstream side of said side connecting portion of said corrugated fin for guiding air having flowed between said corrugated fins toward at least one of said air passages so as to bypass said side connecting portion.

12. A laminated type heat exchanger according to claim 11, wherein said guiding portion is formed by bending said outer peripheries of said core plates.

* * * * *